United States Patent [19]

Golev et al.

[11] Patent Number: 5,033,679

[45] Date of Patent: Jul. 23, 1991

[54] INJECTOR NOZZLE FOR A DIESEL ENGINE

[76] Inventors: Vladislav I. Golev, Suvorovsky prospekt, 61, kv. 165; Rostislav M. Mokhov, ulitsa Marata, 54, kv. 11; Alexandr S. Rusakov, ulitsa Marii Ulyanovoi, 7, kv. 43, all of Leningrad, U.S.S.R.

[21] Appl. No.: 375,717

[22] PCT Filed: Oct. 30, 1987

[86] PCT No.: PCT/SU87/00121

§ 371 Date: Jul. 5, 1989

§ 102(e) Date: Jul. 4, 1989

[87] PCT Pub. No.: WO89/03935

PCT Pub. Date: May 5, 1989

[51] Int. Cl.[5] ..... F02M 61/18

[52] U.S. Cl. ..... 239/533.3

[58] Field of Search ..... 239/533.3–533.12

[56] References Cited

U.S. PATENT DOCUMENTS

| | | | |
|---|---|---|---|
| 2,927,737 | 3/1960 | Zeuch et al. | 239/533.3 |
| 4,153,205 | 5/1979 | Parrish, Jr. | 239/533.9 |

FOREIGN PATENT DOCUMENTS

| | | | |
|---|---|---|---|
| 283154 | 9/1988 | European Pat. Off. | 239/533.5 |
| 3734587 | 5/1989 | Fed. Rep. of Germany | 239/533.12 |
| 3740283 | 6/1989 | Fed. Rep. of Germany | 239/533.3 |
| 49063 | 3/1982 | Japan | 239/533.12 |
| 83505 | 11/1956 | Netherlands | 239/533.3 |
| 227224 | 8/1943 | Switzerland | 239/533.3 |

*Primary Examiner*—Andres Kashnikow
*Assistant Examiner*—Michael J. Forman
*Attorney, Agent, or Firm*—Burgess, Ryan and Wayne

[57] ABSTRACT

The injector nozzle comprises a housing (1) with a conical seat (2) passing into a cylindrical channel (3) with atomizing holes (4). Installed in the housing (1) is a needle (5) with a shut-off truncated cone (6) which is connected, through the intermediate portion (8) of the needle (5), with a throttling element (7). The lateral surface (10) of the intermediate portion (8) of the needle (5) is located inside an imaginary cone (13) and the throttling edge (9) of the throttling element (7) is located at the surface of this cone (13) whose base is constituted by a surface confined by the shut-off edge (12) of the shut-off cone (6) and whose vertex angle ($\alpha$) is 0.5–2.0 degrees greater than the vertex angle (62) of the conical seat (2). The throttling edge (9) is located on the level of the minimum diameter of the conical seat (2) and is formed by the line of intersection of the lateral surface (10) of the intermediate portion (8) of the needle (5) and the lateral surface (11) of the throttling element (7).

4 Claims, 1 Drawing Sheet

INJECTOR NOZZLE FOR A DIESEL ENGINE

FIELD OF THE INVENTION

The invention relates to motor industry and more specifically to injector nozzles for Diesel engines.

PRIOR ART

Some of the principal performance characteristics of Diesel engine injectors are their service life and time between adjustments. These performance characteristics are determined by the following parameters:
injection initiation pressure,
the presence of break-up injection,
tightness along the shut-off cone affecting the fuel atomization quality.

The injection initiation pressure is an adjustable parameter which determines the time between injector adjustments. The presence of break-up injection ensures that the Diesel engine starts at its start-up rotation frequency. The level of tightness along the shut-off cone affects the quality of fuel atomization, determining thus the economic performance of the Diesel engine, the smoking and toxicity of exhaust gases and is a parameter that sets a limit on the ultimate life of the injector nozzle.

An analysis of the defects of injectors arriving from the field at service stations shows that one of the pricipal causes that limit the service life of injection nozzles and the time between injector adjustments is contact-abrasive wear of the shut-off cones and, in the first place, the conical seat of the nozzle whose surface hardness is lower than that of the shut-off cone of the needle.

As the shut-off cones of the nozzle wear out, the needle sinks in the nozzle housing and the shut-off diameter decreases down to the minimum diameter of the conical seat. By "shut-off diameter" we mean the average diamter of the contacting belt of the shut-off cone of a needle with the conical seat of a housing. Wear of the shut-off cones of a nozzle primarily manifests itself as an increase in the differential area of the needle and hence as a decrease in the injection initiation pressure, which cuts down the time between adjustments of the injector and impairs the economic and operating characteristics of a Diesel engine. Also, at a certain degree of wear of the shut-off cone for a specific nozzle design, the break-up injection effect disappears because of a decrease in the build-up of the needle lift force at an initial injection stage due to a decrease in the shut-off diameter.

The ultimate degree of wear of the shut-off cone resulting in a shut-off diameter close to the minimum diameter of a conical seat, leads to irreversible loss of tightness along the shut-off cone and of fuel atomization quality and, eventually, to substantial deterioration of the power and economic characteristics of operation of the Diesel engine, which necessitates replacement of nozzles in real-life operating conditions, i.e. reduces the ultimate service life of the nozzle.

Known in the prior art is an injector nozzle (U.S. Pat. No. 2,927,737) that contains a housing with a conical seat passing into a cylindrical channel with atomizing holes. Installed in the housing is a needle with a shut-off cone whose vertex is located inside the cylindrical channel. The vertex angle of the shut-off cone is 0.5–2 degrees greater than that of the conical seat. The end portion of the shut-off cone performs the functions of a throttle element.

This nozzle design currently enjoys wide use in Diesel engines since it ensures the break-up injection effect and tightness along the shut-off cone till the end of a specified service life.

However, in operation of such a nozzle, the needle sinks because of contact-abrasive wear of the conical seat. With a relatively small distance between the interacting surfaces of the conical seat and the shut-off cone of the needle, which distance is determined by the difference of the angles between them, the shut-off diameter shifts relatively fast to the vertex of the shut-off cone down to the minimum diameter of the conical seat. And as the conical seat wears out, the injection initiation pressure decreases, the break-up injection effect disappears, the quality of atomization deteriorates and tightness is lost.

In order to reduce the effect of wear of the conical seat on nozzle parameters, the shut-off cone of the needle is made truncated, particularly, by confining it, from the side of the smaller base, by a surface perpendicular to the needle axis. With the purpose to ensure the break-up injection effect till the end of a specified service life, the throttling edge in such nozzles is located at the surface of an imaginary cone whose base is constituted by a surface confined by the shut-off edge and whose vertex angle is 0.5–2 degrees greater than that of the conical seat.

In operation of such nozzles, as the conical seat wears out, the shift of the shut-off diameter is confined by the said plane or conical surface. And the shut-off diameter remains about the same so that the injection initiation pressure varies only slightly and the break-up injection effect is conserved, which increases accordingly the time between adjustments and the service life of the nozzle.

Also known in the art is a nozzle (SU, A, 1086204) that contains a housing with a conical seat passing into a cylindrical channel with atomizing holes. Installed in the housing is a needle with a shut-off truncated cone passing into a conical boss that constitutes a throttling element whose vertex is located inside the cylindrical channel. The vertex angle of the conical boss is equal to the angle of the conical seat. The shut-off cone is confined, from the side of the smaller base, by a surface perpendicular to the axis of the needle that forms, on the smaller base of the shut-off cone, a shut-off edge, the diameter ratio between the shut-off edge and the base of the throttling conical boss ranging from 1.01 to 1.20.

Such a nozzle design ensures stabilization of the injection initiation pressure and maintains the break-up injection effect as the seat wears out. However, experiments have shown that the service life of the nozzle is limited by a permissible sinking of the needle, i.e. the distance between the conical bosses and the seat in the axial direction of the needle. Again, increasing diameter ratio between the shut-off edge and the conical boss beyond the above-mentioned values increases the permissible sinking of the needle. However, this decreases the trend of the injector toward break-up fuel injection because of an increase in the throttling cross-section between the seat and the throttling conical boss.

Thus, under the condition of ensuring break-up injection, the service life of nozzle of this design is restricted by the sinking of the needle and does not suffice.

Also known in the art is a nozzle (U.S. Pat. No. 4,153,205) that contains a housing with a conical seat passing into a cylindrical channel with atomizing holes. Installed in the housing is a needle with a shut-off truncated cone having a shut-off edge. The shut-off truncated cone is connected, through the intermediate portion of the needle, with a throttling element having a throttling edge. The latter is located in the seat cavity, has a diameter exceeding the minimum diameter of the seat and is situated at the surface of a cone whose base is constituted by a surface confined by the shut-off edge and whose vertex is 0.5°-2° greater than that of the conical seat. The shut-off cone is confined, from the side of the smaller base, by a surface perpendicular to the needle axis and forming on the smaller base of the shut-off cone a shut-off edge. The throttling element is confined by a plane perpendicular to the needle axis.

The service life of such a nozzle just as that of its previous counterpart, is limited by a permissible sinking of the needle, i.e. by the distance between the throttling edge extending beyond the minimum diameter of the seat, and the seat in the axial direction of the needle.

Besides, the presence of a horizontal edge of the throttling element, which edge is formed by a plane confining the throttling element, results in the fact that, at an initial stage of needle lifting, the effect of built-up of the lift force, which effect ensures break-up injection, is suppressed by an elevated hydraulic resistance offered to needle movement because of the action of flow on the said horizontal edge.

DISCLOSURE OF THE INVENTION

The principal object of the present invention is to provide a Diesel engine injector nozzle in which the conical boss should have such a shape and the throttling edge should be located with respect to the seat so as to increase the distance in the axial direction of the needle between the conical seat and the needle portion located beyond the shut-off cone zone to a value which eliminates the dependence of the nozzle service life on the permissible sinking of the needle, while conserving a throttling cross-section that ensures the break-up injection effect.

With this principal object in view, there is provided an injector nozzle for Diesel engines which contains a housing with a conical seat passing into a cylindrical channel with atomizing holes and a needle installed in the housing and having a shut-off truncated cone that has a shut-off edge and is connected with a throttling element having a throttling edge through the intermediate portion of the needle, the lateral surface of said intermediate portion of the needle being located inside an imaginary cone and the throttling edge, at the surface of this cone whose base is constituted by a surface confined by the shut-off edge and whose vertex angle is 0.5-2.0 degrees greater than that of the conical seat, wherein, according to the invention, the throttling edge is located on the level of the minimum diameter of the conical seat and is formed by the line of intersection of the lateral surface of said intermediate needle portion and the lateral surface of the throttling element.

The location of the throttling edge on the level of the minimum diameter of the conical seat makes it possible to eliminate the dependence of the nozzle service life on the permissible needle sinking and this is why.

This location of the throttling edge predetermines that its diameter is smaller than that of the conical seat, which, in turn, in conjunction with the location of the lateral surface of the intermediate needle portion inside said imaginary cone, makes it possible to increase the distance in the axial direction of the needle between the conical seat and the needle portion located beyond the shut-off cone zone, i.e. to increase the permissible sinking of the needle. And the geometrical shape of the lateral surface of the intermediate portion, which shape determines said distance, may be chosen such that the nozzle service life is limited primarily not by the permissible needle sinking but by other factors, e.g., as shown experimentally, by tightness loss arising from local damages to the seat and needle portions in the zone of the shut-off diameter.

It should be noted that the throttling edge located at the surface of the above-mentioned imaginary cone must have a diameter smaller than the minimum diameter of the conical seat, also in cases where it is located somewhat closer to the shut-off cone. However, in such a location of the throttling edge, its diameter is greater than when said edge is located on the level of the minimum diameter of the conical seat, which leads to the situation where even as a result of small deviations of the axis of the cylindrical channel from the axis of the conical seat which, as a rule, occur in the manufacturing process, the throttling edge extends beyond the minimum diameter of the conical seat, thus decreasing the distance in the axial direction of the needle between the conical seat and the needle portion located beyond the shut-off cone zone since it is the distance between the conical seat and the throttling edge becomes the said distance.

The location of the throttling edge inside the cylindrical channel results in a decrease in its diameter and hence in an increase in the throttling cross-section. In turn, an increase in the throttling cross-section reduces the trend of the nozzle toward break-up injection.

The formation of the throttling edge by the line of intersection of the lateral surface of the intermediate needle portion with the lateral surface of the throttling element promotes the break-up injection effect due to the absence of a horizontal edge of the throttling element.

The lateral surface of the intermediate portion of the needle may be made conical or concave. Such a shape of the lateral surface is readily producible.

The lateral surface portion adjacent to the throttling element may have a cylindrical shape, which simplifies measurement of the diameter of the throttling edge in the process of manufacturing and operating the nozzle.

BRIEF DESCRIPTION OF THE DRAWINGS

The above advantages and features of the present inventions will be clearer from the following detailed description of a preferable implementation of the invention with references to the accompanying drawings, in which.

It should be noted that the accompanying drawings are represented schematically and serve merely as illustrations of the present invention without any limits set on the dimentions involved in the nozzle for which an application is filed or on the ratios between elements, etc.

BEST MODE TO CARRY OUT THE INVENTION

Figure 1:
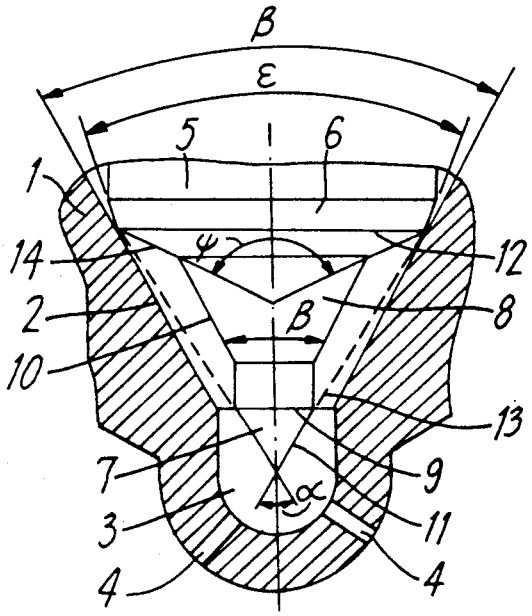
FIG. 1 is a partial sectional view of a nozzle, according to invention.
Figure 2:
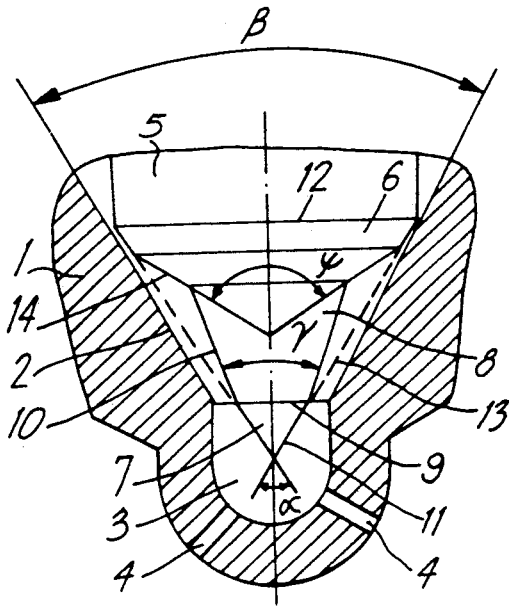
FIG. 2 is partial sectional view of a nozzle having a conical lateral surface on the intermediate portion of the needle.
Figure 3:
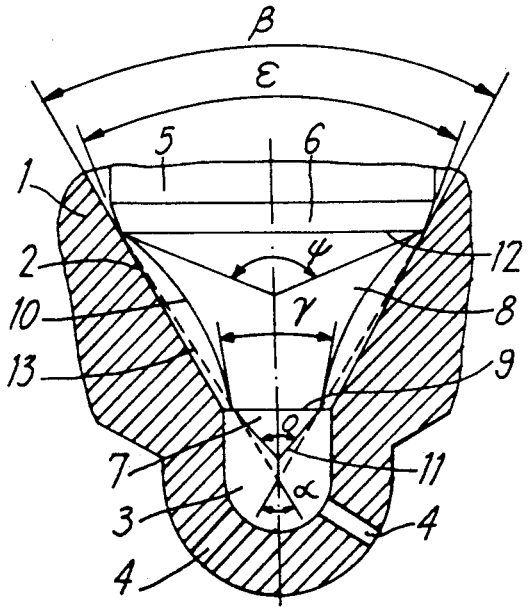
FIG. 3 is a partial sectional view of a nozzle having a concave lateral surface on the intermediate portion of the heedle.

The injector nozzle for a Diesel engine contains a housing 1 (FIG. 1) with a conical seat 2 passing, on its smaller diameter, into a cylindrical channel 3 with atomizing holes 4. Installed in the housing 1, coaxially with the seat 2, is a needle 5 with a shut-off truncated cone 6 and a throttling element 7 interconnected through the intermediate portion 8 of the needle 5. The throttling element 7 has a throttling edge 9 located on the level of the minimum diameter of the conical seat 2 and formed by a line of intersection between the lateral surface 10 of the intermediate portion 8 and the lateral surface 11 of the throttling element 7. The needle 5 is pressed against the seat 2 with the help of a spring (not shown for the sake of simplicity). The shut-off cone 6 interacts with the seat 2 through a shut-off edge 12 located at the smaller base of this cone 6. And the vertex angle $\epsilon$ of the shut-off cone 6 is 0.5–2 degrees smaller than the angle $\beta$ of the conical seat 2. FIG. 2 shows another embodiment of the nozzle, in which the shut-off edge 12 is located on the greater base of the shut-off cone 6. In such a nozzle the vertex angle $\alpha$ of the shut-off cone 6 is 0.5–2 degrees greater than the angle $\beta$ of the conical seat 2. For the location of the shut-off edge 12 on the upper or lower base of the shut-off cone 6, the specified angle difference is a universally adopted value from the condition of ensuring tightness in selective assembly of injector nozzles. The throttling edge 9 lies at the surface of an imaginary cone 13 whose base is constituted by the surface confined by the shut-off edge 12 and the angle $\alpha$ is 0.5–2 degrees greater than the vertex angle of the conical seat 2. The throttling element 7 itself is inscribed in the imaginary cone 13 and may have a conical shape as shown in FIGS. 1, 2 and 3 or another shape, e.g. a spherical one. As is generally known, it is this position of the throttling element 7 with the throttling edge 9 with respect to the conical seat 2 that ensures the break-up injection effect and the largest flow area with a maximum travel of the needle.

The shut-off truncated cone 6 is confined from the side of the smaller base by a conical surface 14 with a vertex angle $\psi$ lying in the range from 80 to 100 degrees. Making a conical surface with such vertex angles reduces the probability of local damages to the contacting portions of the seat and the needle in the shut-off diameter zone and thus increases the service life of the nozzle as regards the tightness of the shut-off cone. Another embodiment of the nozzle is possible, in which the shut-off cone 6 is confined from the smaller base side by a conical surface with a vertex angle $\psi$ exceeding 100 degrees or by a surface perpendicular to the axis of the needle 5. The lateral surface 10 of the intermediate portion 8 of the needle 5 is located inside the imaginary cone 13 and may have various shapes, e.g. a conical (FIG. 2) or a concave shape (FIG. 3) which feature the easiest producibility or a cylindrical shape from the side of the throttling element 7 (FIG. 1) which makes it possible to simplify measurement of the diameter of the throttling edge in the process of manufacturing and operating the nozzle. The angle of slope of the lateral surface 10 shown in FIG. 2, the radius of curvature of the lateral surface 10 shown in FIG. 3 or the length of the cylindrical portion and the angle of slope of the conical portion of the surface 10 shown in FIG. 1 are chosen for the distance in the axial direction of the needle 5 between the conical seat 2 and the lateral surface 10 of the intermediate portion 8 of the needle 5, which distance is the permissible sinking of the needle 5, not to set a limit on the service life of the nozzle. It has been found experimentally that this distance is 0.15–0.30 mm.

The nozzle operates as follows. Under the action of the fuel pressure created by a high-pressure pump (not shown) on the differential area of the needle 5 equal to the difference between the cross-sectional area of the guide (not shown) of the needle 5 and the cross-sectional area of the shut-off edge 12, the needle 5 starts to rise. At the initial moment of the lifting of the needle 5, fuel flow throttling occurs between the seat 2 and the shut-off edge 12. Because of the difference in diameter between the shut-off edge 12 and the throttling edge 9, the flow area between the shut-off edge 12 and the conical seat 2 increases, during the lifting of the needle 5, much more rapidly than the flow section between the throttling edge 9 and the conical seat 2 does. With a certain critical travel of the needle 5, the throttling cross-section moves from the shut-off edge 12 to the throttling edge 9, which is accompanied by a sharp increase in the differential area and the lift force of the needle 5. At a low rate of pressure build-up taking place in acceptance test or in Diesel start-up procedures, the above effect causes fuel break-up injection. The location of the throttling edge 9 not below the level of the minimum diameter of the conical seat 2 and the formation of said edge by a line of intersection of the lateral surface 10 of the intermediate portion 8 of the needle 5 and the lateral surface 11 of the throttling element 7 make it possible to meet the generally known requirements for obtaining the break-up injection effect. With further increasing pressure, the needle 5 continues to rise to the stop, effecting thus the principal injection of fuel into the combustion chamber of the Diesel engine. In such a case, with the aim to reduce pressure losses, the flow area between the needle 5 and the conical seat 2 must be as large as possible. The location of the throttling element 9 inside the imaginary cone 13 is a necessary condition for reduced pressure losses at a maximum travel of the needle.

With decreasing pressure in the nozzle cavity, the needle 5 returns to its initial position under the action of a spring (not shown).

As the nozzle is used, the needle 5 sinks because of contact-abrasive wear of the portion of the conical seat 2 interacting with the shut-off cone 6. And in the case of the location of the shut-off edge 12 on the smaller base of the shut-off cone 6 (FIGS. 1 and 3), the shut-off diameter remains practically unchanged due to the presence of the conical surface 14. In the case of the location of the shut-off edge 12 on the greater base of the cone 6 (FIG. 2), the shut-off diameter shifts from the shut-off edge 12 to the smaller base of the cone 6, after which it remains practically unchanged. A shift of the shut-off diameter does not substantially affect the service life of the nozzle in this case since the height of the shut-off truncated cone 6 amounts only to 0.3–0.4 mm.

As the needle 5 sinks, the throttling edge 9 moves into the cylindrical channel 3 while continuing to perform its function since the throttling cross-section remains unchanged. The permissible sinking of the needle 5 is determined by the distance between the seat 2 and the lateral surface 10 of the intermediate portion 8. And this distance can be ensured by selecting appropriately the geometrical shape of the lateral surface 10 for the service life of the nozzle to be limited primarily not by the permissible sinking of the needle 5 but by other factors such as tightness loss arising from local damages to the portions of the seat 2 and needle 5 in the zone of the shut-off diameter or from wear of the needle-housing pair.

INDUSTRIAL APPLICABILITY

The proposed injector nozzle for a Diesel engine can find wide application in all Diesel engines having enclosed nozzles.

We claim:

1. An injector nozzle for a diesel engine comprising:

a) a housing including:

i) a plurality of atomizing holes through which a fuel exits the housing, ii) a cylindrical channel in fluid communication with the atomizing holes for supplying fuel thereto, and iii) a truncated conical seat forming an opening in fluid communication with the cylindrical channel for supplying fuel to the cylindrical channel, said conical seat having a vertex angle associated therewith and a minimum diameter section; and b) a needle installed in the housing, said needle including:

i) a shut-off truncated cone with a shut-off edge for engagement with the conical seat, ii) a throttling element with a throttling edge and a lateral surface, the throttling edge being located level with the minimum diameter section of the conical seat in a closed position of said nozzle, iii) an intermediate portion which connects the throttling element with the truncated cone, said intermediate portion having a lateral surface such that said lateral surface of the intermediate portion is located inside an imaginary cone extending between said truncated cone shut-off edge and said throttling edge, said imaginary cone having a vertex angle which is in the range of 0.5 to 2.0 degrees greater than the vertex angle of the conical seat, and iv) the throttling edge being formed by a line of intersection of the lateral surface of the intermediate portion of the needle and the lateral surface of the throttling element.

2. An injector nozzle according to claim 1, wherein said lateral surface of the intermediate portion is conical.

3. An injector nozzle according to claim 1, wherein said lateral surface of the intermediate portion is concave.

4. An injector nozzle according to claim 1, wherein said lateral surface of the intermediate portion includes a cylindrical portion adjacent to the throttling element.

* * * * *